US006431541B2

(12) United States Patent
Kuo et al.

(10) Patent No.: US 6,431,541 B2
(45) Date of Patent: Aug. 13, 2002

(54) FEEDING MECHANISM

(75) Inventors: Ying-Hsien Kuo, Taipei; Tsung-Te Lin, Taipei Hsien, both of (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/847,023

(22) Filed: May 1, 2001

(30) Foreign Application Priority Data

May 3, 2000 (TW) ..... 89108360 A

(51) Int. Cl.[7] ..... B65H 3/06
(52) U.S. Cl. ..... 271/118; 271/121; 271/124
(58) Field of Search ..... 271/109, 117, 271/118, 121, 124, 241, 245, 246

(56) References Cited

U.S. PATENT DOCUMENTS 4,674,736 A * 6/1987 Tsubo ..... 271/245
4,934,686 A * 6/1990 Ono et al. ..... 271/117
5,205,550 A * 4/1993 Perino ..... 271/245
5,253,861 A * 10/1993 Schmaling ..... 271/245
5,297,789 A * 3/1994 Filsinger et al. ..... 271/245
5,932,313 A * 8/1999 Barton ..... 271/117
6,000,689 A 12/1999 Furuki et al. ..... 271/10.11

FOREIGN PATENT DOCUMENTS

GB 333406 * 8/1930 ..... 271/245

* cited by examiner

*Primary Examiner*—H. Grant Skaggs
(74) *Attorney, Agent, or Firm*—Ladas & Parry

(57) ABSTRACT

The feeding mechanism for feeding media from an initial site to a predetermined site comprises a base, a scrubber, a deskewer, two feeders, a lifting device having two cam portions, a driving element and a releasing device. The deskewer is moved between a first position and a second position and sets the media located at the initial site. The two feeders are used for transmitting the media located at the initial site toward the predetermined site. The cam portions are used as a lifter to move the deskewer from the first position to the second position. The driving element disposed between the lifting device and the releasing device generates forces to actuate the cam portions to move the deskewer. The releasing device is used as an overload protection clutch connected between the lifting device and the driving element, having a first plate separately contacting the driving element. As the driving element is actuated, the driving force generated from the driving element can be transmitted to the cam portions via the releasing device, and the overload from the driving element can be properly set free by the releasing device.

12 Claims, 8 Drawing Sheets

FEEDING MECHANISM

BACKGROUND OF THE INVENTION

1. Field of the Invention

This invention relates to a feeding mechanism. More particularly, this invention relates to a feeding mechanism provided with a releasing device to effectively set free the overload.

2. Description of Prior Art

Most feeding mechanisms are provided with a deskewer to deskewer the media or papers during the feeding process. The deskewer is generally a plate which is upwardly moved or pushed up by a transmission mechanism.

However, adding the transmission mechanism increases the complexity of the feeding mechanism and the driving force generated from the transmission mechanism is not easily controlled. Once the driving force is too high or the overload cannot be properly released, the feeding process of the media or papers is abnormally interrupted.

SUMMARY OF THE INVENTION

To solve the above problem, the primary object of this invention is to provide a feeding mechanism to feed media from an initial site to a predetermined site. The feeding mechanism comprises a base, a scrubber, a deskewer, two feeders, a lifting device having two cam portions, a stopper, a driving element and a releasing device.

The deskewer is disposed between the initial site and the predetermined site, and the deskewer is moved between a first position and a second position and contacts the media located at the initial site. The feeder is movably disposed next to the initial site to transmit the media located at the initial site toward the predetermined site. The cam portions of the lifting device are used as a lifter to move the deskewer from the first position to the second position. The stopper is disposed next to the deskewer to limit the deskewer's motion between first position and second position. The driving element disposed between the lifting device and the releasing device generates forces to actuate the lifting device to move the deskewer to the second position. The releasing device is used as an overload protection clutch, which is connected between the lifting device and the driving element and has a first plate separately contacting the driving element. As the driving element is actuated, the driving force generated from the driving element can be transmitted to the cam portions via the releasing device, and the overload from the driving element can be properly set free by the releasing device.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

Figure 1A:
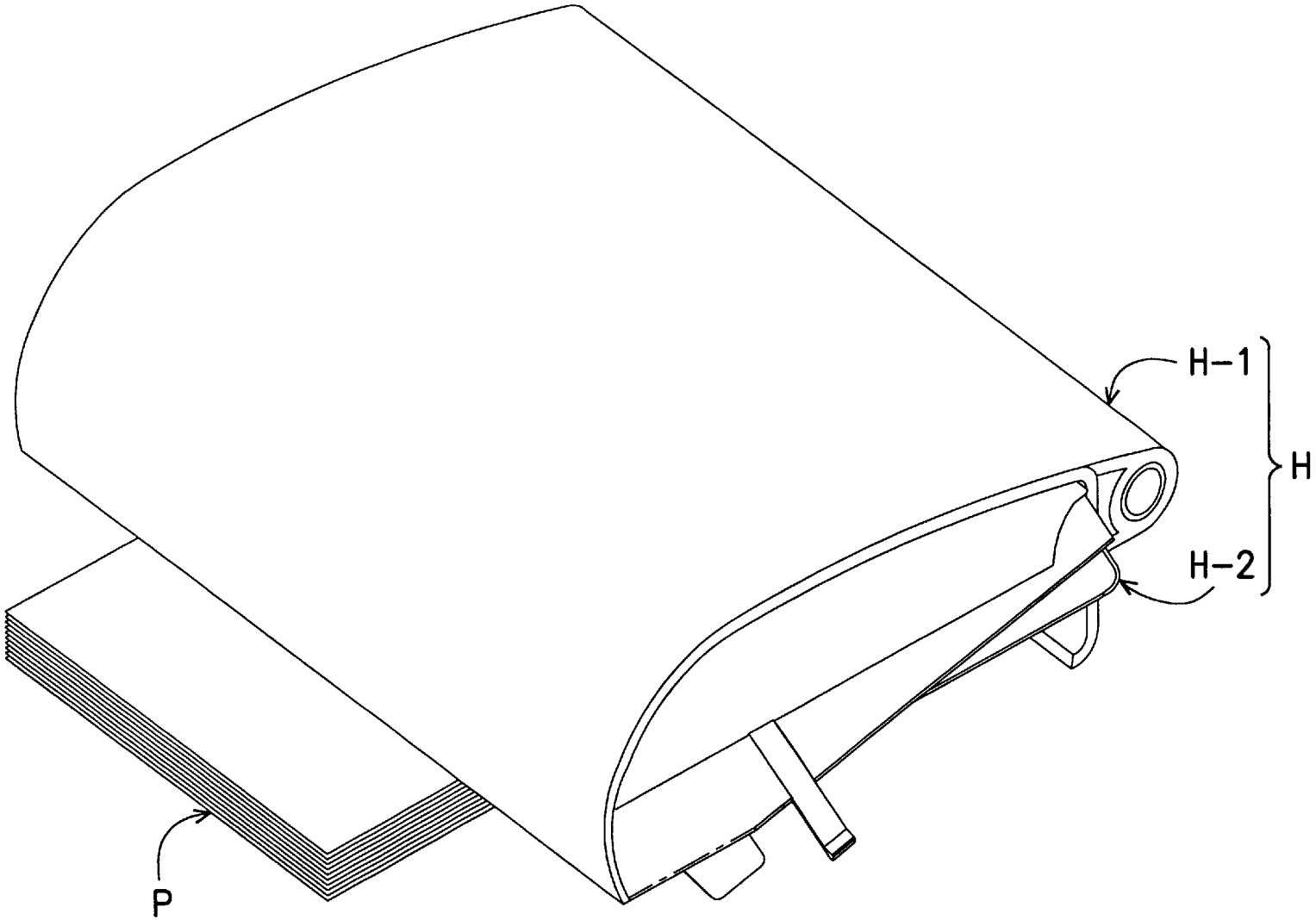
FIG. 1A is a perspective view showing the outer structure of a feeding mechanism (1) of the present invention, comprising an outer case (H) which is composed of an upper housing (H-1) and a lower housing (H-2)

Referring to FIG. 1A, FIG. 1A is a perspective view showing the outer structure of a feeding mechanism 1 of the present invention. An upper housing H-1 and a lower housing H-2 are constructed on the outer structure of the feeding mechanism 1. A stack of media P, such as papers, can be fed by the feeding mechanism 1 to a printing device (not shown).

Figure 1B:
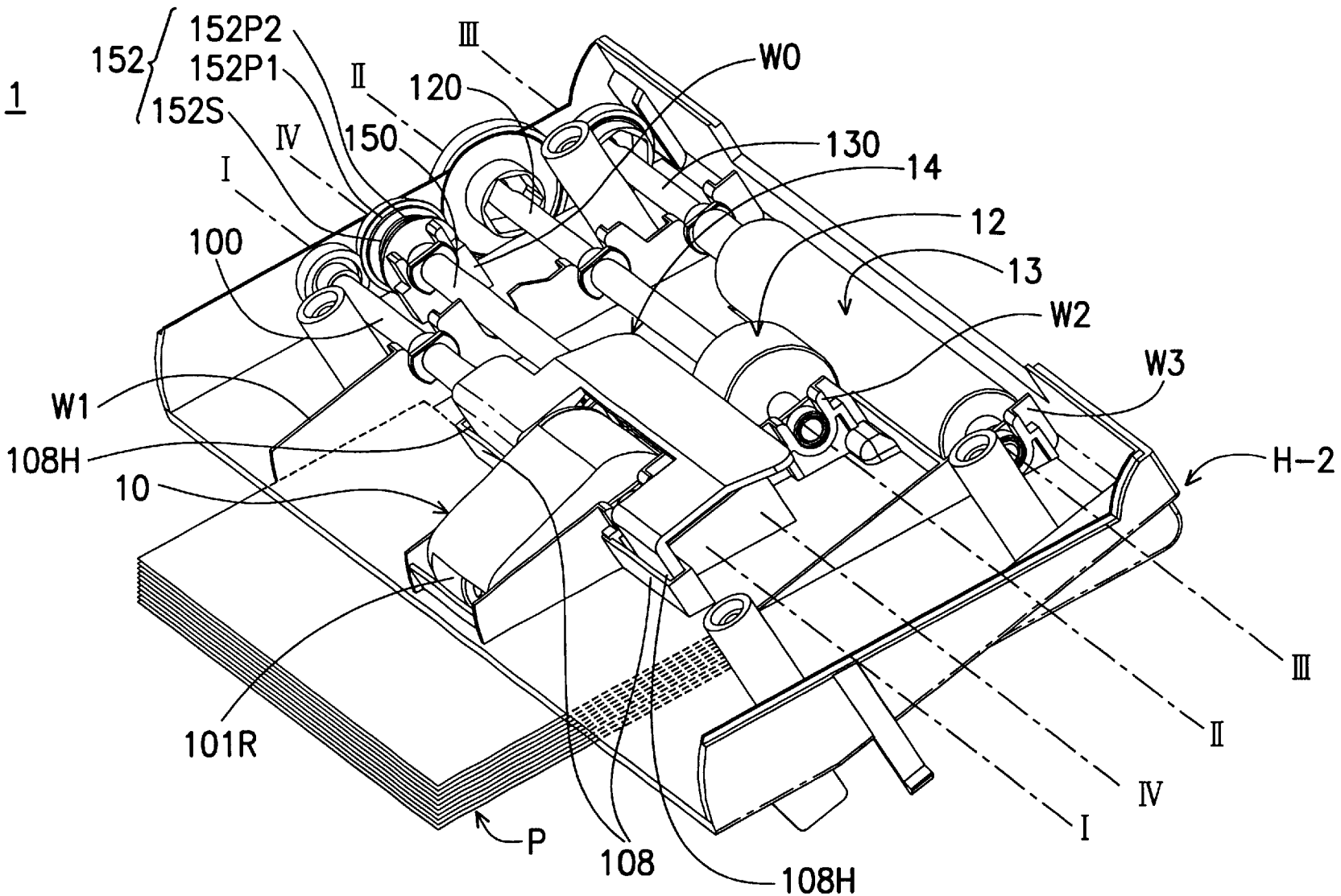
FIG. 1B is a perspective view showing the inner structure of the feeding mechanism (1) without the upper housing (H-1) according to FIG. 1A.
Figure 2:
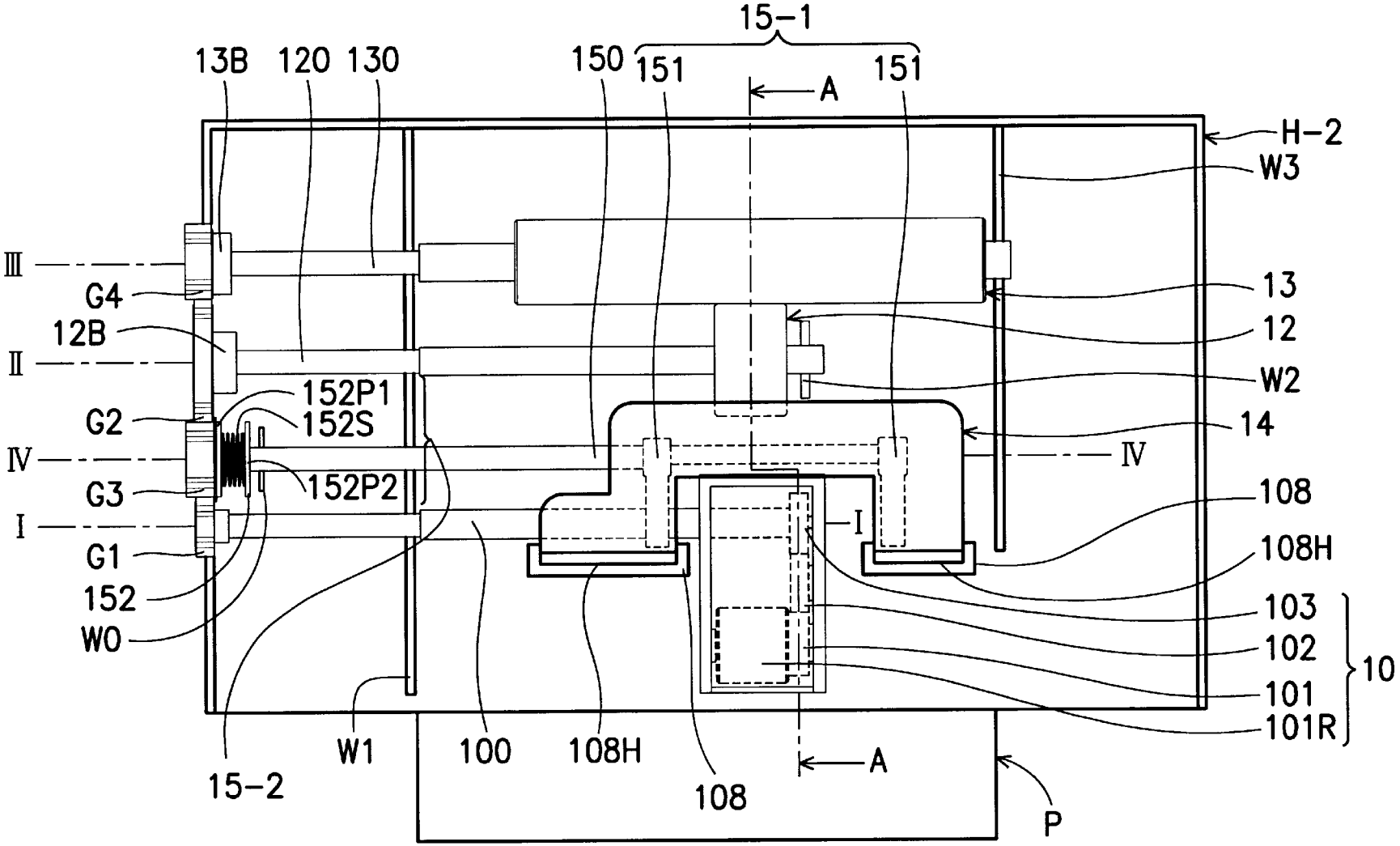
FIG. 2 is a top view of FIG. 1B.

In FIG. 1B a perspective view shows the inner structure of the feeding mechanism 1, from which the upper housing H-1 is taken off, and FIG. 2 is a top view of FIG. 1B. The lower housing H-2 is used as a base so as to support all the elements of the feeding mechanism 1. Besides the upper housing H-1 and the lower housing H-2 mentioned, the feeding mechanism 1 further comprises a scrubber 10, two feeders 12 and 13, a first one-way bearing 12B, a second one-way bearing 13B, a deskewer 14, a lifting device 15-1, a releasing device 15-2 and a stopper 18.

The deskewer 14, essentially an L-shaped board in a cross-section view movably guided along the two holes 108-H of the guiding seats 108, is actuated by the cam 151 between a first position S01 and a second position S02 (see FIG. 3) so as to align the media before the feeding procedure. All elements are supported by the lower housing H-2 and covered by the upper housing H-1.

The first one-way bearing 12B and the second one-way bearing 13B are disposed on the lower housing H-2, and four supporting seats W0, W1, W2 and W3 respectively protrude from the inner bottom surface of the lower housing H-2 and substantially parallel to each other. Four cylindrical shafts 100, 120, 130 and 150 are mounted on the bottom of the lower housing H-2 and respectively rotated about a first axis I-I, a second axis II-II, a third axis III-III and a fourth axis IV-IV, which are substantially designed parallel to each other. The supporting seat W1 mainly supports the shaft 100, and the supporting seat WO and W1 mainly support the shaft 150, and the supporting seats W1 and W2 mainly support the shaft 120, and the supporting seats W1 and W3 mainly support the shaft 130.

The relationships among the four shafts (100, 120, 130 and 150) and of the elements relative to each of shafts will be depicted as follows with reference to FIG. 2.

[Shaft 100]

FIG. 2 is a top view of FIG. 1B. A first gear portion G1 and the scrubber 10 are respectively mounted on two ends of the shaft 100, and the shaft 100 is rotated about the axis I-I by the first gear portion G1.

Three pulleys 101, 102, 103 and a feeding roller 101R comprise the scrubber 10. The pulley 103 is directly connected to the shaft 100, and the pulley 102 is used as an idler engaged to the pulleys 101 and 103, and the feeding roller 101R affixed to the pulley 101 is used as a passive element.

Once the first gear portion G1 is energized, the driving shaft 100, therefore, can directly actuate the scrubber 10 rotated within a predetermined path with respect to the third axis I-I, and the feeding roller 101R can be controlled and rotated to scrub the media P.

[Shaft 150]

In FIG. 2, a third gear portion G3 is engaged with the first gear portion G1 and used as a driving element placed on the lower housing H-2. The lifting device 15-1 comprises two cam portions 151(151) spaced apart and fixedly mounted on one end of the shaft 150. The L-shaped deskewer 14 guided by the holes 108H of the guiding seats 108 is freely and uniformly disposed on the two cam portions 151(151).

The releasing device 15-2 is used as an overload protection clutch disposed between the lifting device 15-1 and the third gear portion G3. The releasing device 15-2 is installed on another end of the shaft 150 and separately presses on the driving element 150G. The releasing device 15-2 has a first plate 152P1, a second plate 152P2 and a spring 152S, wherein the spring 152S is disposed between the first plate 152P1 and the second plate 152P2, and the is second plate 152P2 is fixed to the shaft 150. One sidewall of the third gear portion G3 is separately pushed and pressed by the first plate 152P1 when the releasing device 15-2 is disposed on the shaft 150.

As the third gear portion G3 is actuated, the driving force generated from the third gear portion G3 can be transmitted to the shaft 150 via the releasing device 15-2.

[Shaft 120 and 130]

In FIG. 2, the feeder 12 is integrally built on the shaft 120, and the first one-way bearing 12B as well as the supporting seats W1 and W2 are used together to support the shaft 120. A second gear portion G2 is formed on the first one-way bearing 12B and engaged to the third gear portion G3.

The feeder 13 larger than the feeder 12 is integrally built on the shaft 130, and the second one-way bearing 13B as well as the supporting seats W1 and W3 are used together to support the shaft 130. A third gear portion G4 is formed on the second one-way bearing 13B and engaged to the second gear portion G2.

Figure 3:
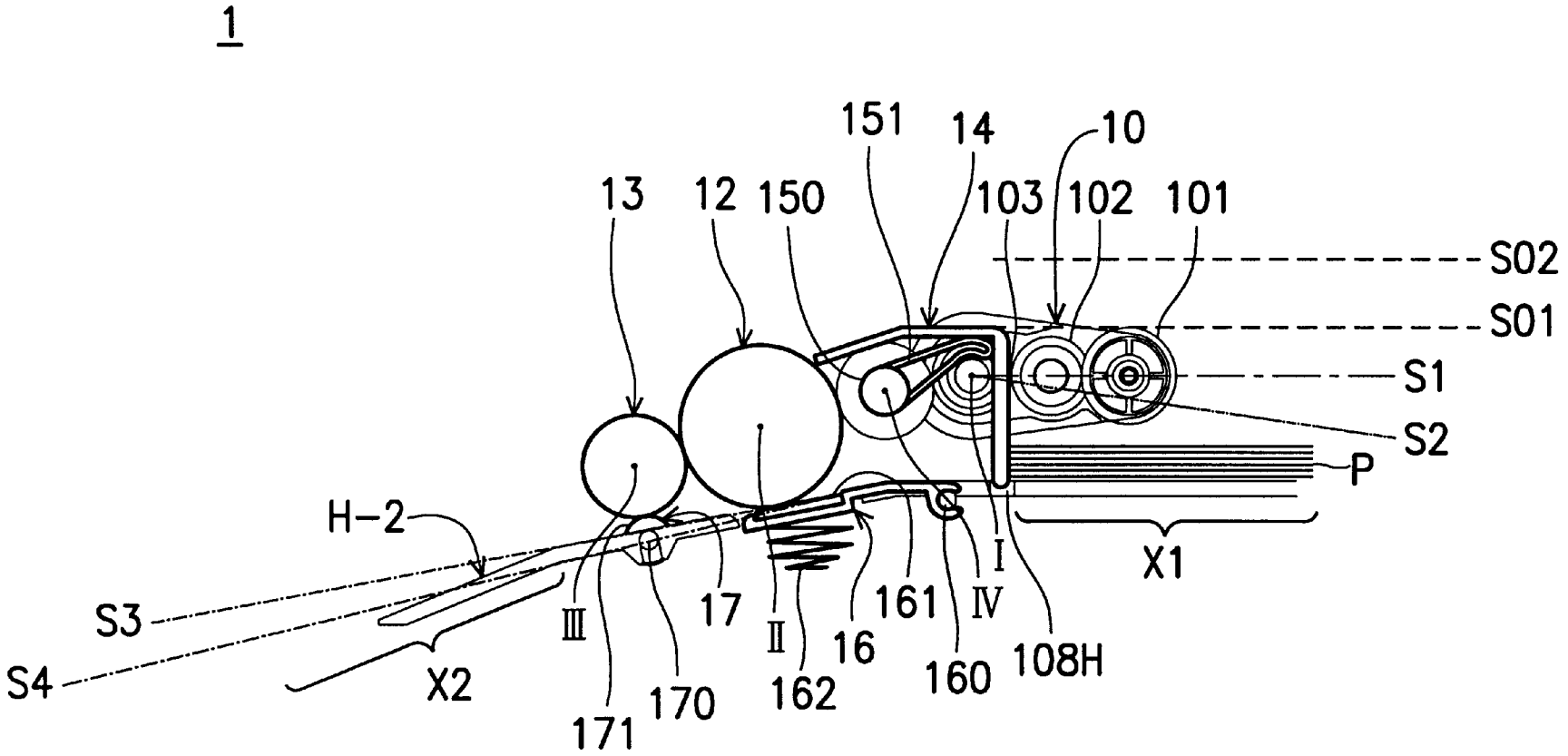
FIG. 3 is a side view of the feeding mechanism (1) according to a sectional line (A—A) of FIG. 2, wherein the feeding mechanism (1) is used to transmit the media (P) from an initial site (X1) to a predetermined site (X2)

FIG. 3 is a side view of the feeding mechanism 1 according to a sectional line A—A of FIG. 2.

The scrubber 10 can be moved within a predetermined path angled from line S1 to line S2. The lower housing H-2 is provided with an initial site X1, a predetermined site X2, a first surface 161 and a second surface 171, wherein the first surface 161 and the second surface 171 are located between the initial site X1 and the predetermined site X2. The initial site X1 is a place used to receive the media P before the scrubber 10 takes them, and the predetermined site X2 is another place used as a destination to receive the media P.

A plate 16 which is pivoted on an axis 160 and suspended by a spring 162 and a roller 17 which is pivoted on another axis 170 are mounted on the lower housing H-2, respectively. The plate 16 is provided with the first surface 161, which is moveable and separately contacts the feeder 12 by the spring 162 and moved along a predetermined path between line S3 and line S4. The roller 17 is provided with the second surface 171, which contacts the feeder 13.

FIGS. 4A to 4D shows how the media P is transmitted by the feeding mechanism 1 from the initial site X1 to the predetermined site X2.

Figure 4A:
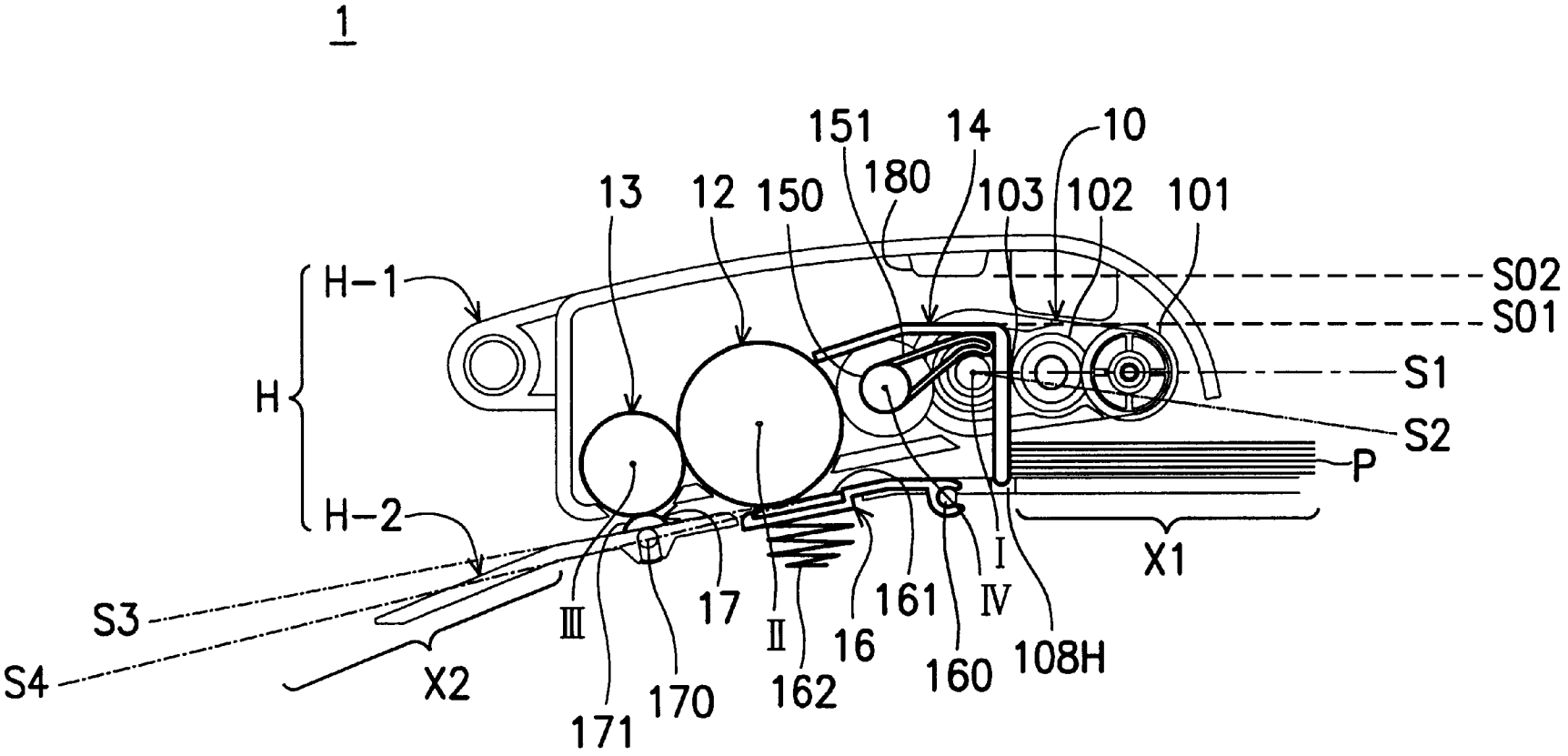
FIGS. 4A to 4D are four figures sequentially depicting the steps for feeding the media (P) or papers from the initial site (X1) to the predetermined site (X2) by the feeding mechanism (1)

In FIG. 4A, the feeding mechanism 1 is covered with the upper housing H-1 and is ready to use the scrubber 10 to scrub the media P.

Before the media P is scrubbed by the feeding roller 101R, the second gear portion G2 (in FIG. 2) is actuated in a first direction, such as counterclockwise, by the third gear portion G4 which is connected to a motor (not shown) or the same, and the third gear portion G3 is rotated a second direction, such as clockwise, by the second gear portion G2. The third gear portion G3 actuates the shaft 150 rotated in clockwise direction through the releasing device 15-2. The deskewer 14 is lowered to position S01 by its own weight and the cam portions 151(151) are pushed and rotated clockwise following the movement of the deskewer 14. The media P, therefore, can be located and skewed at the initial site X1 by the deskewer 10.

When the deskewer 10 properly sets the media P located at the initial site X1, a motor (not shown) begins to actuate the third gear portion G4 rotated in the counterclockwise direction. Then, the third gear portion G3 is rotated counterclockwise through the second gear portion G2, and then the first gear portion G1 is rotated clockwise through the third gear portion G3, and then the scrubber 10 is rotated clockwise from line S1 toward line S2.

Figure 4B:
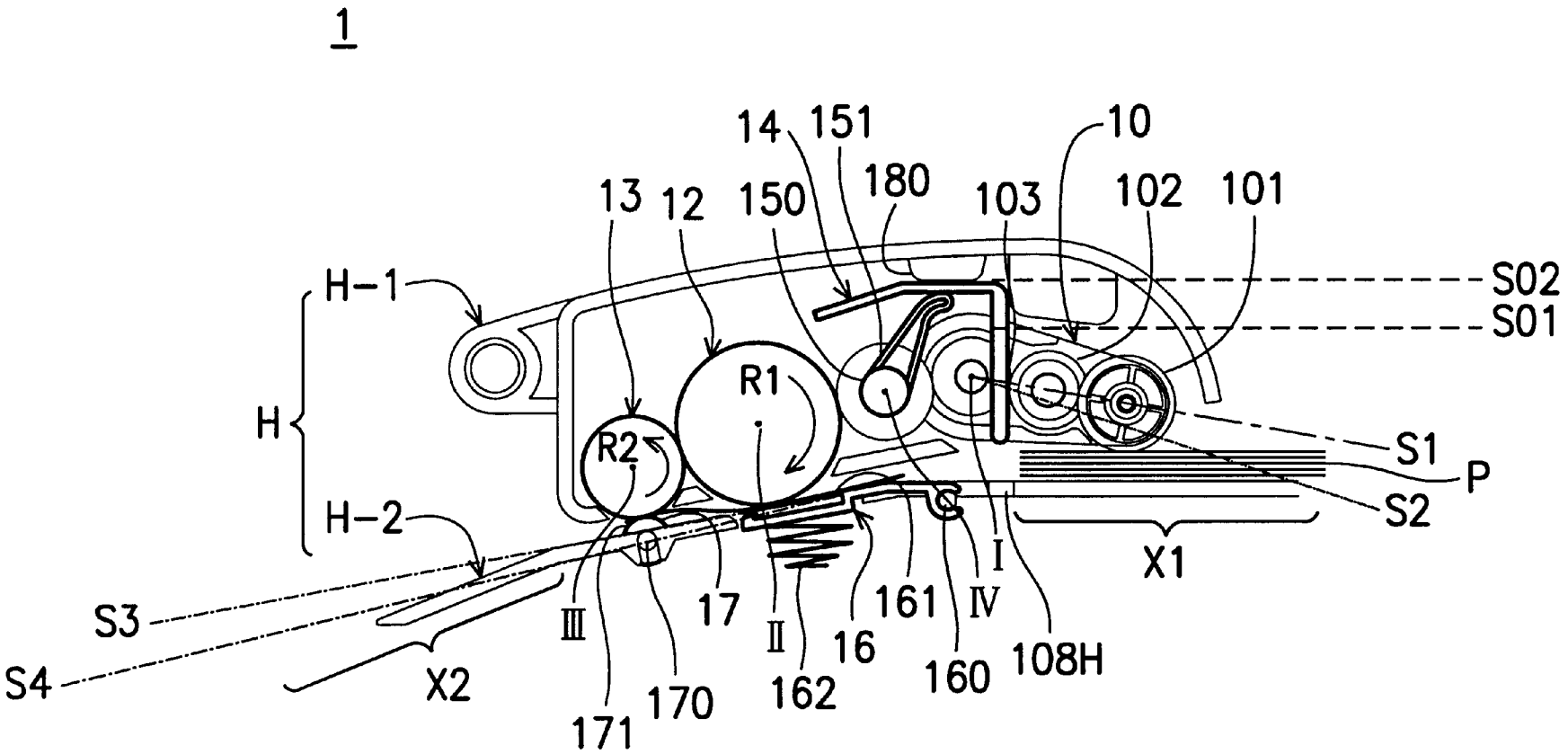

In FIG. 4B, the feeder 13 is rotated in the counterclockwise direction R2, and the cam portions 151(151) are also rotated counterclockwise and the deskewer 14 is elevated from the first position S01 toward the second position S02 by following the movement of the cam portions 151(151). When the elevating deskewer 14 contacts the stopper 180, and the deskewer 14 is stopped and limited at position S02, and the third gear portion G3 begins to slide on the first plate 152P1 (see FIG. 2) of the releasing device 15-2, and there are no further effective frictional forces generated. Then, the scrubber 10 is rotated from line S1 to line S2, and the feeding roller 1011R starts to scrub the top of the media P and passes it toward the feeder 12.

Then, the media P passed from the feeding roller 101R contacts the feeder 12 and the plate 16, and then the media P is frictionally clamped therebetween and transmitted toward the feeder 13. Because the frictional force between any two overlapped sheets is far smaller than the one between the sheet and the feeder 13 or the one between the sheet and the plate 16, only one sheet is allowed to pass between. When the media P transmitted by the feeder 12 contacts the feeder 13 and the guiding roller 17, the feeder 13 rotated counterclockwise can be used as a deskewer to correct the leading edge of the media P parallel to the third axis III-III.

Figure 4C:
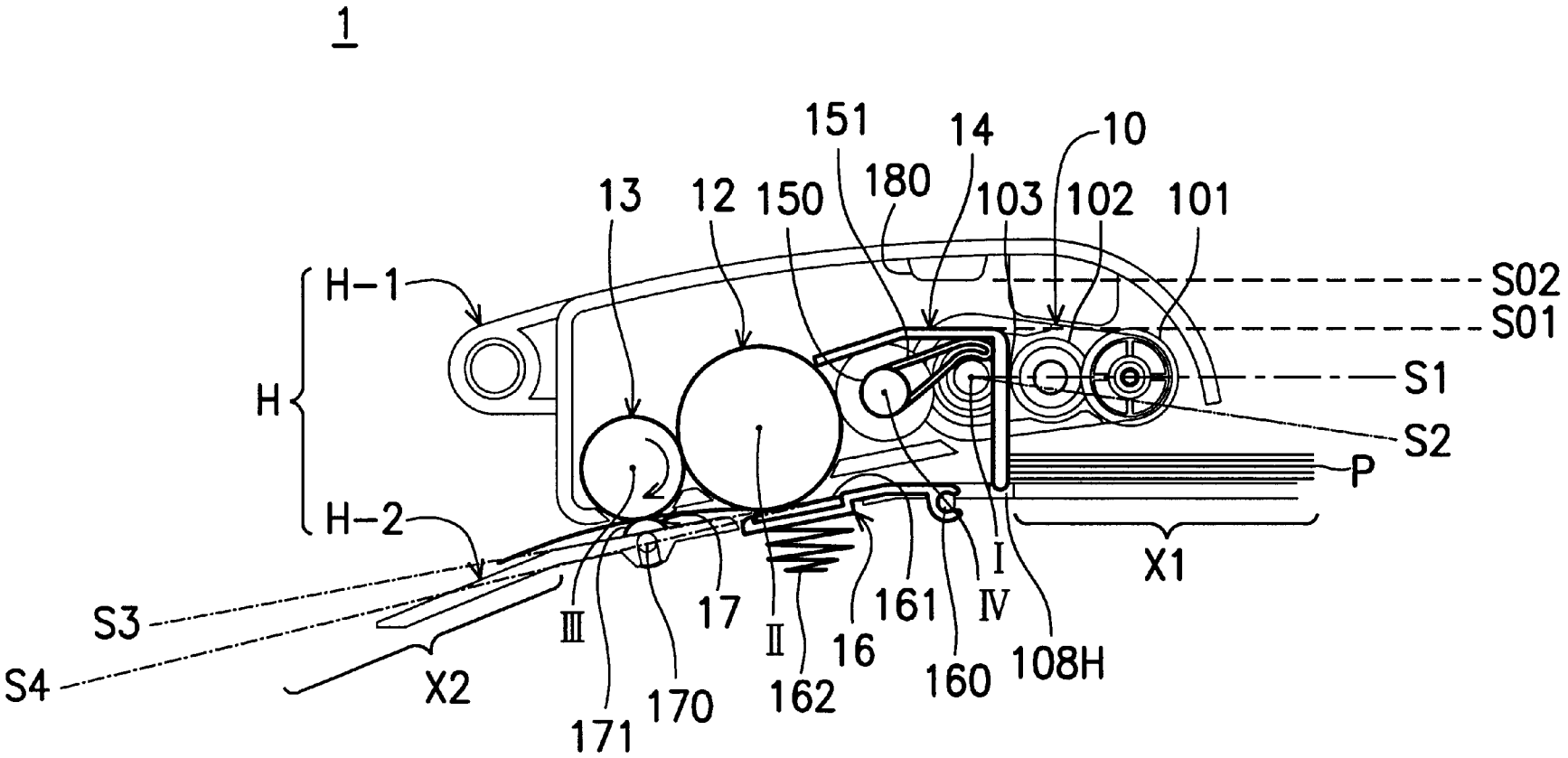
Figure 4D:
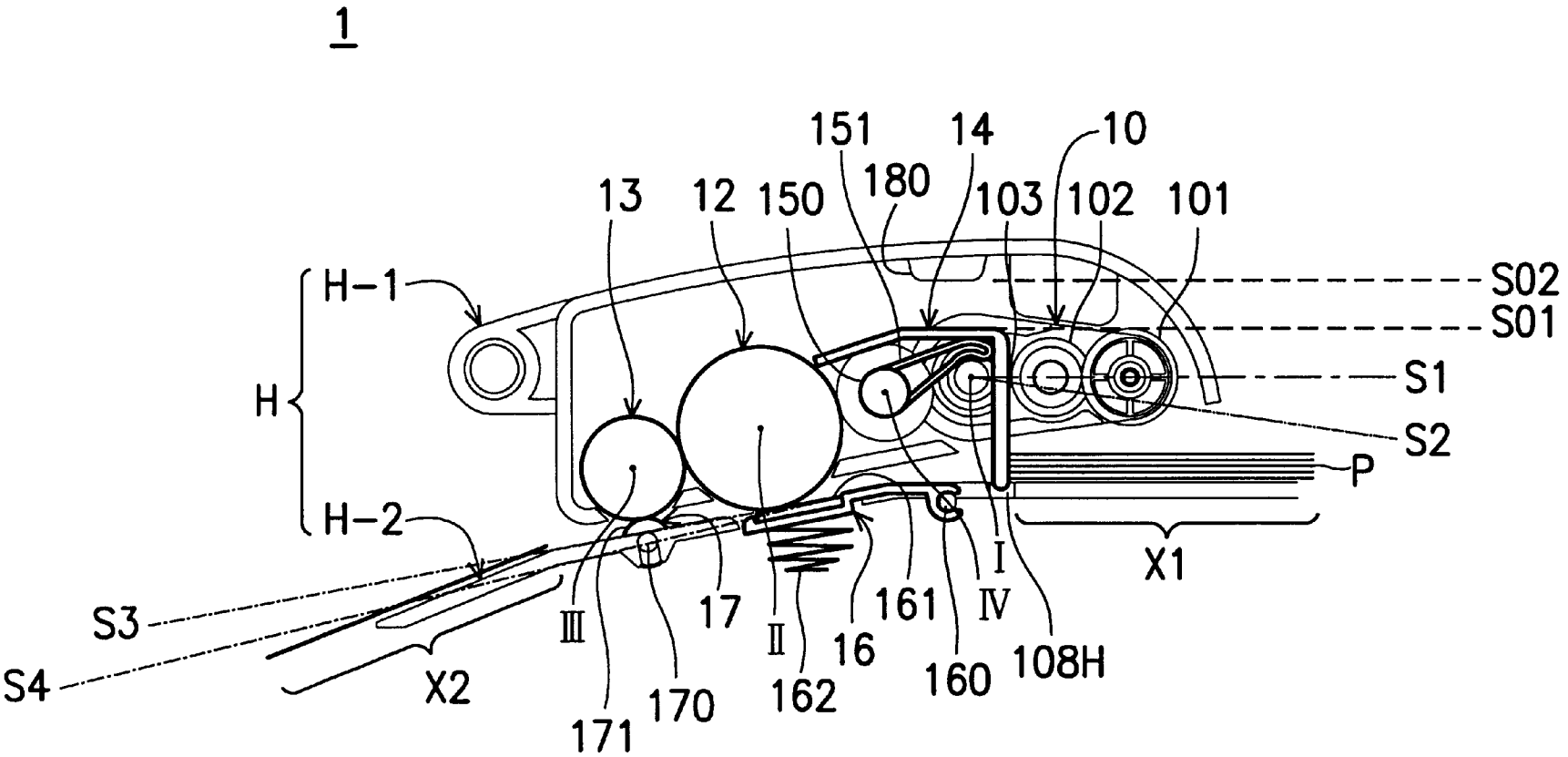

Then, referring to FIG. 4C, the feeder 13 begins to rotate clockwise to press the media P on the guiding roller 17 and frictionally transmit it toward the predetermined site X2 when the deskewing process is finished. In FIG. 4D, the media P escapes from the clamp between the feeder 13 and the guiding roller 17 and finally arrives at the predetermined site X2. The deskewer 14 is lowered to the first position S01 by its own weight and the cam portions 151(151) are pushed and rotated clockwise following the movement of the deskewer 14. Then, the third gear portion G3 begins to slide on the first plate 152P1 of the releasing device 15-2, and there are no further effective frictional forces generated between the third gear portion G3 and the first plate 152P1.

The deskewer 14, therefore, is properly kept at the first position S01 and prepares for the next feeding process from the media P stacked in the initial site X1, and the overload from the third gear portion G3 (driving element) can be properly set free by the releasing device 15-2.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for feeding media from an initial site to a predetermined site, comprising:

a deskewer disposed between the initial site and the predetermined site, moved between a first position and a second position and contacting the media located at the initial site;

a feeder movably disposed next to the initial site to transmit the media located at the initial site toward the predetermined site;

a lifting device for moving the deskewer from the first position to the second position, having a cam contacting the deskewer;

a driving element for actuating the lifting device, connected to the lifting device; and a releasing device disposed between the lifting device and the driving element, having a first plate separately contacting the driving element.

2. The apparatus as claimed in claim 1, wherein the releasing device further comprises a second plate and a spring which is connected between the first plate and the second plate.

3. The apparatus as claimed in claim 1, wherein the media are papers.

4. The apparatus as claimed in claim 1, wherein the deskewer is an L-shaped board in a cross-section view.

5. The apparatus as claimed in claim 1, wherein the deskewer movably guided along two guiding holes is actuated by the cam, so as to align the media.

6. The apparatus as claimed in claim 1, further comprising a first gear portion used for actuating a scrubber portion, a second gear portion used for actuating the feeder, and a third gear portion connected to the releasing device and engaged between the first gear portion and the second gear portion.

7. An apparatus for feeding media from an initial site to a predetermined site, comprising:

a deskewer disposed between the initial site and the predetermined site, moved between a first position and a second position and contacting the media located at the initial site;

a feeder movably disposed next to the initial site to transmit the media located at the initial site toward the predetermined site;

a lifting device for moving the deskewer from the first position to the second position, having a cam contacting the deskewer;

a stopper for limiting the deskewer moved between the first position and the second position, disposed next to the deskewer;

a driving element for actuating the lifting device, connected to the lifting device; and a releasing device disposed between the lifting device and the driving element, having a first plate separately contacting the driving element.

8. The apparatus as claimed in claim 7, wherein the releasing device further comprises a second plate and a spring which is connected between the first plate and the second plate.

9. The apparatus as claimed in claim 7, wherein the media are papers.

10. The apparatus as claimed in claim 7, wherein the deskewer is an L-shaped board in a cross-section view.

11. The apparatus as claimed in claim 7, wherein the deskewer movably guided along two guiding holes is actuated by the cam, so as to align the media.

12. The apparatus as claimed in claim 7, further comprising a first gear portion used for actuating a scrubber portion, a second gear portion used for actuating the feeder, and a third gear portion connected to the releasing device and engaged between the first gear portion and the second gear portion.

* * * * *